US005357773A

United States Patent [19]

Rohde et al.

[11] Patent Number: 5,357,773

[45] Date of Patent: Oct. 25, 1994

[54] METHOD OF LONGITUDINAL ROLLING OF SEAMLESS PIPE

[75] Inventors: Johann H. Rohde, Ratingen; Burkhart Schifferings; Rolf Kümmerling, both of Duisburg; Jochen Vochsen, Mönchengladbach; Karl H. Häusler, Korschenbroich; Gunther Voswinckel, Mönchengladbach, all of Fed. Rep. of Germany

[73] Assignee: Mannesmann Aktiengesellschaft, Dusseldorf, Fed. Rep. of Germany

[21] Appl. No.: 159,951

[22] Filed: Nov. 29, 1993

Related U.S. Application Data

[63] Continuation of Ser. No. 976,361, Nov. 16, 1992, abandoned.

[30] Foreign Application Priority Data

Nov. 15, 1991 [DE] Fed. Rep. of Germany ..... 4138178

[51] Int. Cl.[5] ..... B21B 17/02

[52] U.S. Cl. ..... 72/10; 72/205; 72/209; 72/370

[58] Field of Search ..... 72/10, 12, 208, 209, 72/205, 235, 370

[56] References Cited

U.S. PATENT DOCUMENTS 3,392,565 7/1968 Rodder ..... 72/370

4,002,048 1/1977 Pozsgay ..... 72/205

FOREIGN PATENT DOCUMENTS

3221722A1 7/1983 Fed. Rep. of Germany .

0104207 6/1984 Japan ..... 72/235

*Primary Examiner*—Lowell A. Larson

*Assistant Examiner*—Thomas C. Schoeffler

*Attorney, Agent, or Firm*—Cohen, Pontani, Lieberman, Pavane

[57] ABSTRACT

A method of longitudinal rolling of seamless pipes in a continuous rolling procedure on an internal tool in a multiple-stand rolling train, wherein the rolls of successive rolling stands are mounted off set relative to each other. In accordance with the present invention, in a first of only two successive rolling passes, a roll thickness reduction is produced with opened roll groove sides in the roll groove bottom which reduction corresponds to or is slightly greater than the roll thickness of the finished pipe. In the second rolling pass, the side portion of the first rolling pass is reduced in the direction of the width to the wall thickness of the finished pipe in the roll groove bottom of the second rolling pass. By simultaneously applying a controlled tensile force on the pipe between the two rolling passes, the increase of the circumference of the pipe due to spreading is reduced by stretching the pipe in the direction of its longitudinal axis without reducing the wall thickness or with only a slight reduction of the wall thickness.

2 Claims, 3 Drawing Sheets

METHOD OF LONGITUDINAL ROLLING OF SEAMLESS PIPE

This is a continuation of application Ser. No. 07/976,361 filed Nov. 16, 1992, now abandoned.

BACKGROUND OF THE INVENTION

1. Field of the Invention

The present invention relates to a method of longitudinal rolling of seamless pipes in a continuous rolling procedure over an internal tool in a multiple-stand rolling train, wherein the rolls of successive rolling stands are arranged offset relative to each other.

2. Description of the Related Art

In known rolling procedures for the manufacture of seamless steel pipes, a distinction is made between transverse rolling procedures and longitudinal rolling procedures. In the transverse rolling procedure, the shape of the pass of the deforming rolls does not have to be adapted to the cross section of the pipe. On the other hand, in the longitudinal rolling procedure, an essentially round or closed pass shape is required.

In addition, in longitudinal rolling procedures with internal tool of the type to which the present invention is directed, a distinction is made between single-stand rolling mills, such as, the Stiefel-type piercing rolling mill, and multiple-stand trains, such as, the known continuous pipe rolling train with a rolling rod or mandrel which travels through freely or with a rolling mandrel which is pulled along in a controlled manner. The continuous rolling trains have the disadvantage that they require a relatively large number of rolling stands which constitute a substantial investment. While 20 years ago eight rolling stands were still required, the number of stands was reduced during the following years. It has already been proposed to construct rolling trains with five rolling stands (speech by Palma, Tube 91, Chicago from Jun, 17 to Jun, 19, 1991 "NEW TENDS IN SEAMLESS TUBE MAKING"). This publication also contains proposals to reduce the number of stands to 4 or 3. The publication further mentions that when fewer than 5 stands are used, only a simple pipe length of approximately 15 meters can be achieved. On the other hand, when using rolling trains with 5 or more stands, double pipe lengths of up to approximately 30 meters can be achieved in pipes having thin walls and pipes having normal walls. Pipes having normal walls are considered in the art to be pipes having dimensions as defined in DIN 2448. Pipes having thin walls have a wall thickness of 90% of normal walls.

It is a prerequisite that the inclined piercing mill before the rolling train produces pierced shells or hollow blanks which are sufficiently long. Modem inclined piercing mills produce hollow blank lengths of 12 meters and more.

SUMMARY OF THE INVENTION

Starting from the recognition that a smaller number of rolling stands means a substantial reduction in investment, it is the object of the present invention to provide a method in which a lowest possible number of rolling stands is capable of producing sufficiently great stretching for manufacturing double pipe lengths.

In accordance with the present invention, in a first of only two successive rolling passes, a wall thickness reduction is produced with opened roll groove sides in the roll groove bottom which reduction corresponds to or is slightly greater than the roll thickness of the finished pipe. In the second rolling pass, the side portion of the first rolling pass is reduced in the direction of the width to the wall thickness of the finished pipe in the roll groove bottom of the second rolling pass. By simultaneously applying a controlled tensile force on the pipe between the two rolling passes, the increase of the circumference of the pipe due to spreading is reduced by stretching the pipe in the direction of its longitudinal axis without reducing the wall thickness or with only a slight reduction of the wall thickness.

In order to obtain a double pipe length of 30 meters, a stretching ratio of 2.5 : 1 is required in the continuous rolling train when hollow blanks are used which have a length of 12 meters. This cannot be achieved with two stands when conventional pass configurations are used because such a pass configuration which is usually closed limits the wall thickness reduction due to so-called sucking in the roll groove sides and because the two round stands are missing which are conventionally provided in multiple-stand trains and which provide the rolled pipe with a round shape. Moreover, it must be observed that in closed groove configurations the wall thickness produced in the groove bottom of the first pair of rolls is reduced in the groove changeover of the second pair of rolls still in an undefined manner because almost the entire stretching action in the second rolling stand results in an extension of the pipe, while only a small portion thereof results in spreading. As a result of the stretching, the wall is also stretched in the groove changeover of the second rolling stand in longitudinal direction of the pipe and, thus, the wall thickness is reduced by the stretching action. Accordingly, a uniform wall thickness over the entire pipe circumference can only be achieved if the extent of reducing the wall thickness in the second rolling stand is already taking into account in the wall thickness configuration in the first rolling stand.

The proposal of the invention makes it possible to achieve the uniform wall thickness by opening the groove of the first rolling pass relatively widely and facilitating a significant roll thickness reduction in the groove bottom. As a result, it is possible to adjust the final wall thickness or at least almost the final wall thickness already in the groove bottom of the first roll pass. Since the second groove is opened at the groove sides to such an extent that the entire or at least the predominant portion of the deformation does not occur as longitudinal stretching but as spreading in the groove sides, it can be avoided that the wall is stretched thin in the groove side of the second pair of rolls. This would result in a pipe cross-section which has an approximately elliptical shape, i.e. a shape which would not be suitable for entering the next following finishing rolling unit. Therefore, in accordance with another feature of the present invention, it is proposed to adjust a defined tension between the two stands by increasing the rate of rotation of the rolls of the second rolling stand to such an extent which is required to stretch the pipe only until it rests with slight play on the rolling mandrel. The stretching action controlled in this manner results in a reduction of the pipe circumference, but not in a reduction of the wall thickness, so that the pipe rolled in accordance with the proposed method has a uniform wall thickness over the entire circumference thereof.

In accordance with a further development of the invention, the ovality of the rolled pipe is measured after the second rolling pass and the deviation from the desired value is used as a pulse for controlling the difference of the rates of rotation of the drive motors. It is apparent that one of the drive motors can be used as a pilot motor with constant rate of rotation which serves as a guiding value for the controllable drive of the second rolling stand.

The present invention can be utilized in an advantageous manner in continuous rolling mills with freely travelling mandrel as well as with a mandrel which is pulled along in a controlled manner.

In the following, an example will be described which demonstrates the possible stretching distribution between the inclined rolling unit arranged in front of the continuous train of the present invention and the rolling mill according to the present invention.

Starting with a blank having a diameter of 177 millimeters and a length of 3,460 millimeters, a pierced shell is produced which has a diameter of 183.7 millimeters, a wall thickness of 13.25 millimeters, and a length of 12,000 millimeters. Accordingly, the stretching ratio is approximately 3.47 : 1.

The pierced shell having a length of 12,000 millimeters is subsequently rolled in the rolling mill with two rolling stands according to the present invention and is stretched by 2.48 : 1, so that the emerging pipe has a diameter of 164 millimeters and a wall thickness of 5.70 millimeters. The length of the emerging pipe is approximately 30,000 millimeters.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DESCRIPTION OF THE PREFERRED EMBODIMENTS

Figure 1:
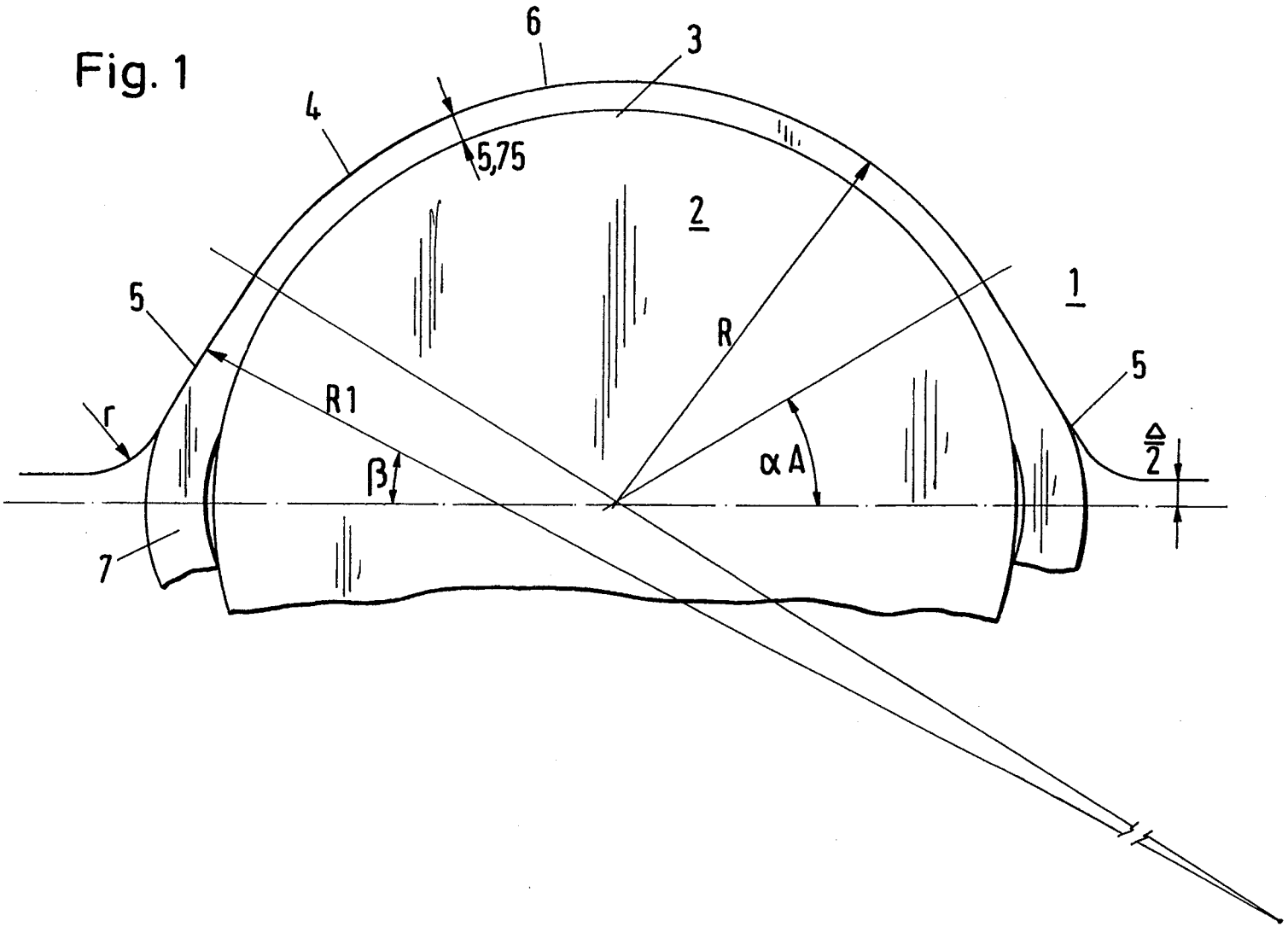
FIG. 1 is a schematic sectional view of the groove configuration of the first rolling pass according to the present invention.

In FIG. 1 of the drawings, reference numeral 1 denotes a portion of the upper roll and reference numeral 2 denotes the internal tool. The illustrated rolling stand is a two-high stand. The lower roll is arranged and constructed symmetrical relative to the upper roll 1. The groove 4 of each roll is open in the areas of the groove sides 5, i.e. the radius of the groove in the region of the sides is greater than the radius of the groove in the groove bottom 6. The gap 3 between internal tool 2 and roll 1 in the groove bottom 6 corresponds approximately to the final wall thickness or is slightly greater. In the region of the groove sides 5, the gap between internal tool and groove 4 is greater because of the opening of the sides 5, so that a greater wall thickness results in this region as compared to the region of the groove bottom 6.

Figure 2:
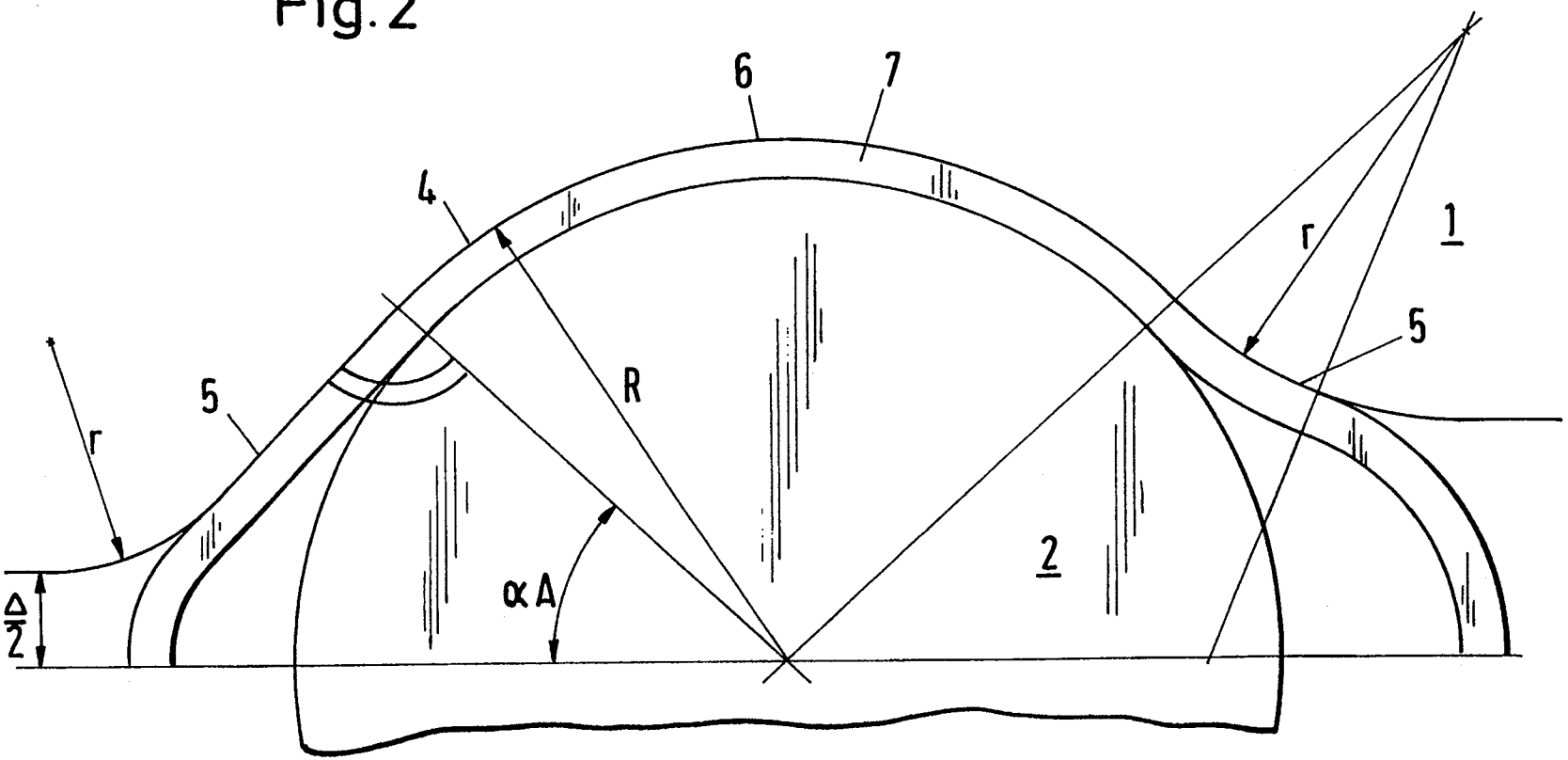
FIG. 2 is a schematic sectional view of the groove configuration of the second rolling pass.

FIG. 2 of the drawings shows the groove configuration of the second rolling pass, wherein the rolls are mounted turned by 90° relative to the rolls of FIG. 1. FIG. 2 shows two different groove configurations in the left-half of the drawing and the right-half of the drawing. However, both configurations are provided with a distinct opening of the groove sides 5 of the groove 4, while the final pipe wall thickness is adjusted between the internal tool 2 and the roll 1 in the region of the groove bottom 6. The distinct opening of the groove in the regions of the sides 5 has the effect that the side portions of the pipe emerging from the first rolling pass shown in FIG. 1 are deformed in the groove bottom 6 of the second rolling pass and, because of the lateral opening of the groove in the regions of the sides, a material flow takes place almost exclusively so as to cause spreading, i.e. in circumferential direction of the pipe. As can be seen in FIG. 2, this would result in a significant increase of the circumference of the pipe. In other words, an approximately elliptical shape of the pipe would result.

Figure 3:
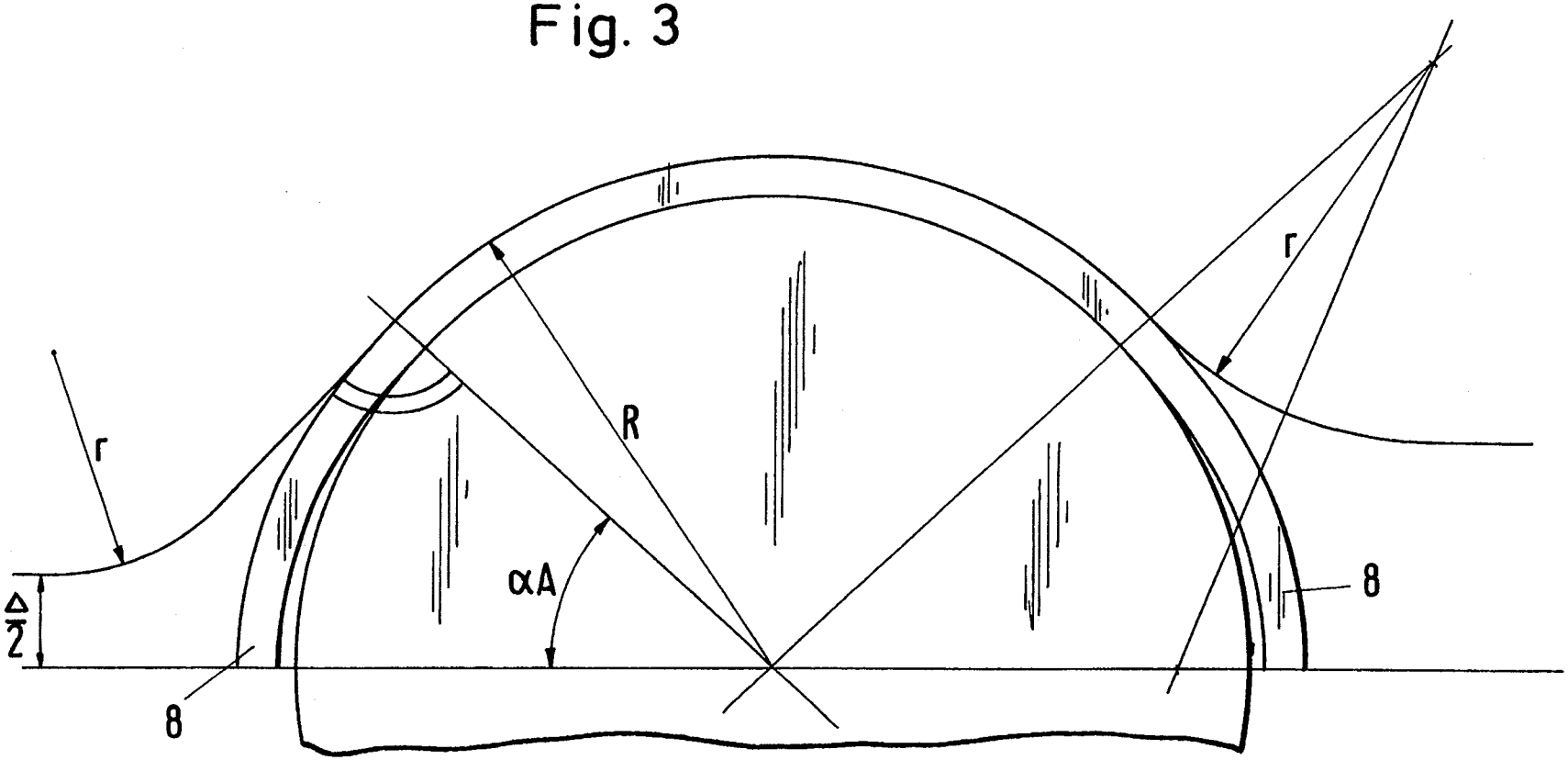
FIG. 3 shows the cross-section of the pipe after leaving the second rolling pass.

In order to prevent this elliptical shape, the present invention provides that the pipe is stretched between the two passes shown in FIGS. 1 and 2 in such a way that the pipe is not subjected to spreading to reach an oval shape illustrated in the drawings, but the material which has the tendency to be subject to spreading is pulled in longitudinal direction. In this manner, the pipe 8 assumes a round shape and rests with slight play against the internal tool, as shown in FIG. 3, without causing stretching and reducing the final wall thickness determined in the groove bottom of the first rolling pass. Only a slight reduction of the final roll thickness from the groove bottom 6 of the first rolling pass as shown in FIG. 1 is permissible, i.e. the final wall thickness in the first pass may be selected slightly greater in order to achieve, after a slight stretching, the final wall thickness in the groove bottom of the second pass.

It has been found that the method according to the present invention makes it surprisingly possible to operate a continuous rolling train with only two rolling stands successfully even for high stretching ratios of up to 2.5 : 1 and, simultaneously, to obtain pipes of good roundness.

It should be understood that the preferred embodiments and examples described are for illustrative purposes only and are not to be construed as limiting the scope of the present invention which is properly delineated only in the appended claims.

What is claimed is:

1. A method of longitudinal rolling of seamless steel pipes in a continuous rolling procedure on an internal tool in a two stand rolling mill train, wherein the rolling stands have rolls which are mounted offset relative to each other, the method comprising rolling each pipe in two successive rolling passes, each rolling pass having open roll groove sides and a roll groove bottom, wherein a wall thickness reduction of portions of the pipe is effected in the groove bottom of the first rolling pass which corresponds to a final wall thickness of the pipe or the reduction is slightly less than the final wall thickness of the pipe, and wherein the portions of the pipe rolled at the groove sides of the first rolling pass are rolled in the groove bottom of the second rolling pass to obtain the final wall thickness of the pipe by spreading in the direction of the circumference, and simultaneously applying a controlled tensile force on the pipe between the two rolling passes so as to reduce an increase of the circumference to the pipe caused by the spreading and to stretch the pipe in longitudinal direction without reducing the final wall thickness or with only a slight reduction of the final wall thickness.

2. The method according to claim 1, wherein the two rolling stands are driven by drive motors and wherein the rolled pipe leaves the second rolling stand with an ovality, comprising measuring the ovality and utilizing a deviation from a desired ovality as a pulse for controlling a difference of rate of rotations of the drive motors of the two stands.

* * * * *